US005302925A

United States Patent [19]

Castonguay et al.

[11] Patent Number: 5,302,925

[45] Date of Patent: Apr. 12, 1994

[54] CIRCUIT BREAKER ROTARY HANDLE OPERATOR WITH POSITIVE ON INDICATION

[75] Inventors: Roger N. Castonguay, Terryville; James L. Rosen, West Hartford, both of Conn.

[73] Assignee: General Electric Company, New York, N.Y.

[21] Appl. No.: 74,633

[22] Filed: Jun. 11, 1993

[51] Int. Cl.[5] ..... H01H 73/12

[52] U.S. Cl. ..... 335/17; 200/43.14

[58] Field of Search ..... 200/43.14, 43.15; 335/17

[56] References Cited

U.S. PATENT DOCUMENTS

| | | | |
|---|---|---|---|
| 2,512,505 | 6/1950 | Rowe | 200/41.15 |
| 2,695,934 | 11/1954 | Wills | 200/41.14 |
| 3,260,808 | 7/1966 | Dimond et al. . | |
| 4,736,174 | 4/1988 | Castonguay et al. . | |
| 4,978,816 | 12/1990 | Castonguay et al. . | |

*Primary Examiner*—Lincoln Donovan

*Attorney, Agent, or Firm*—Richard A. Menelly

[57] ABSTRACT

A molded case circuit breaker rotary handle operator allows the circuit breaker handle to be locked when the circuit breaker contacts are open. The handle is prevented from being locked in position when the circuit breaker contacts are welded in their closed condition.

6 Claims, 5 Drawing Sheets

CIRCUIT BREAKER ROTARY HANDLE OPERATOR WITH POSITIVE ON INDICATION

BACKGROUND OF THE INVENTION

U.S. Pat. No. 3,260,808 entitled "Electric Switch with Lockable Rotary Operator" described a circuit breaker that provides rotary operation to a circuit breaker operating handle. The handle can be locked in its OFF position to allow an operator to work on the associated electric equipment without danger of the circuit breaker handle being inadvertently turned ON to electrically energize the equipment.

In extreme circumstances, such as described in U.S. Pat. No. 4,978,816, the circuit breaker contacts could become welded together in their closed condition. When the circuit breaker operating handle is later moved to the reset position, the circuit breaker contacts could conceivably remain welded together. Locking the circuit breaker handle could then erroneously indicate to an operator that the associated equipment is electrically de-energized.

One purpose of this invention is to describe a rotary handle operator that allows positive ON indication by preventing the circuit breaker operating handle from being locked in the OFF position unless the circuit breaker contacts are in their open condition.

SUMMARY OF THE INVENTION

The invention comprises a molded case circuit breaker rotary handle operator that allows the circuit breaker operating handle to be turned ON and OFF by rotary action. The padlock plate extending from the rotary handle is prevented from operation unless the circuit breaker contacts are open.

DESCRIPTION OF THE PREFERRED EMBODIMENT

Figure 1:
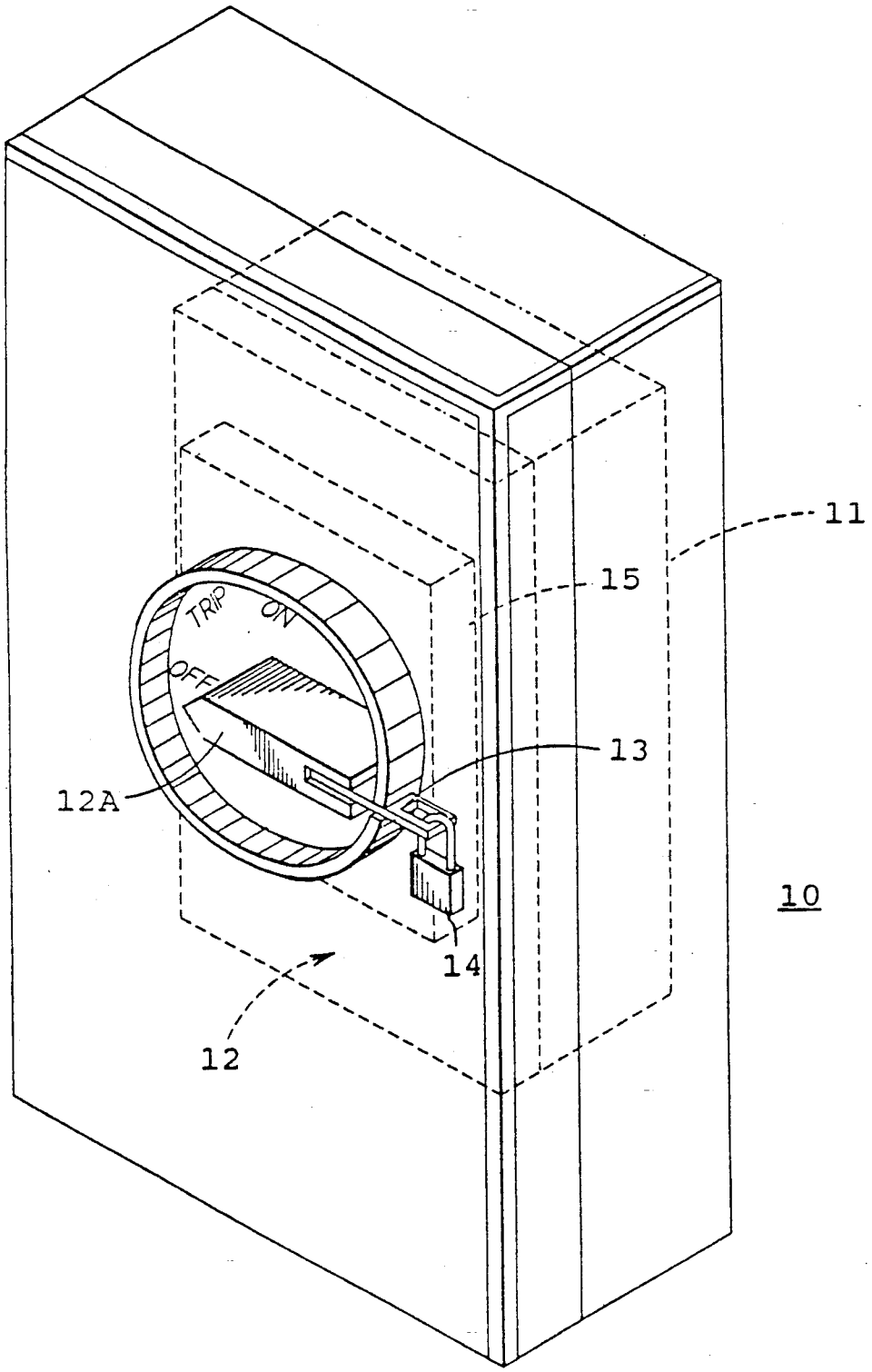
FIG. 1 (PRIOR ART)
FIG. 1 is a front perspective view of a molded case circuit breaker enclosure containing a circuit breaker and rotary operator according to the prior art.

Before describing the circuit breaker rotary handle operator (hereinafter "rotary operator") of the invention, it is helpful to first review the operation of the rotary operator 12 described in the aforementioned U.S. Pat. No. 3,260,808. The circuit breaker enclosure 10 depicted therein is shown in FIG. 1 and contains an industrial-rated rotary operated circuit breaker 11 that is externally accessed by means of a rotary handle-indicator 12A on the housing 15 of the rotary operator 12. The rotary handle 12A is locked in the OFF position by means of a locking plate 13 and padlock 14.

Figure 2:
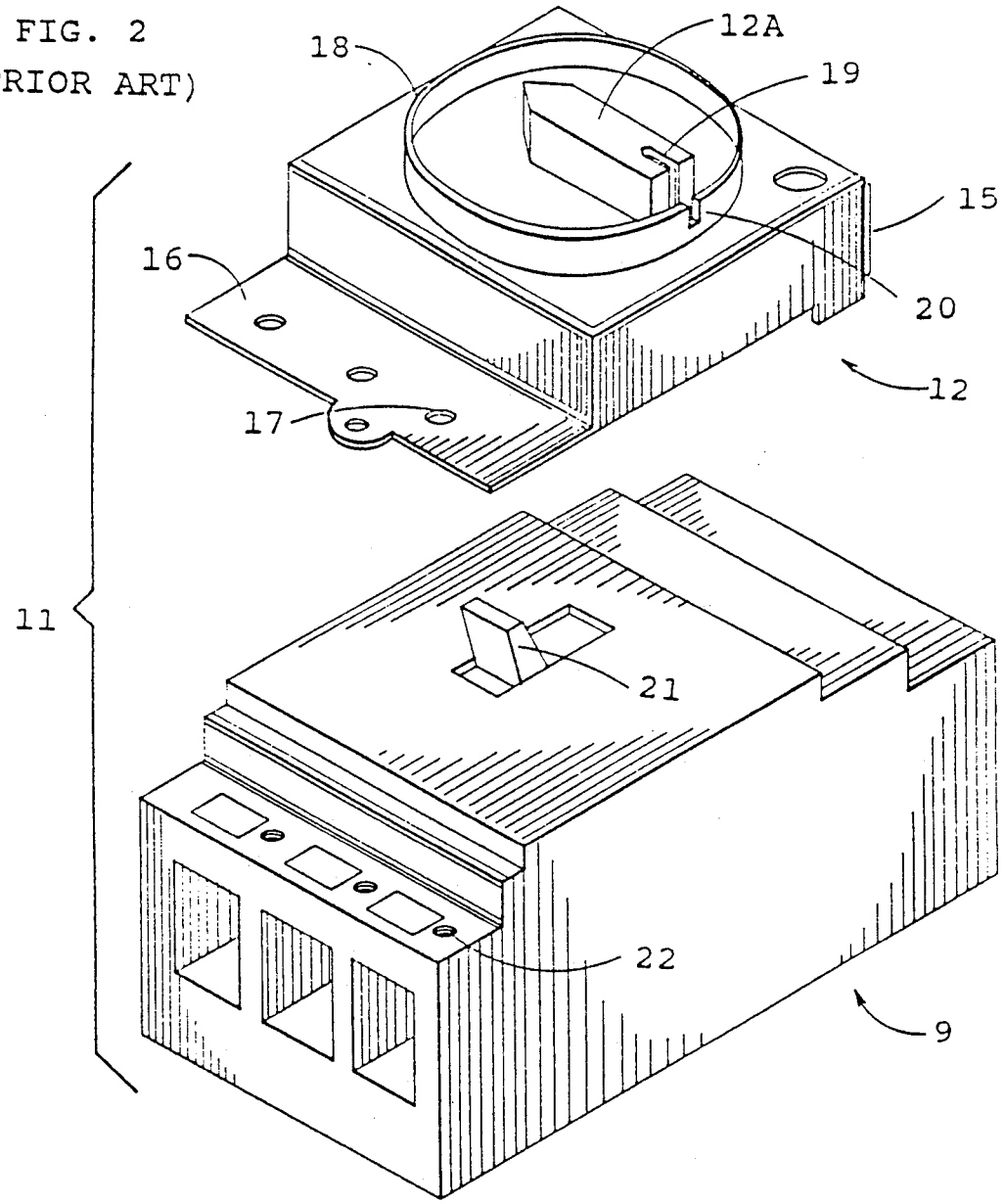
FIG. 2 (PRIOR ART)
FIG. 2 is a top perspective view of the circuit breaker of FIG. 1 prior to attachment to the circuit breaker.

The rotary operator 12 is shown in FIG. 2 prior to attachment to the circuit breaker 9 by means of thru-holes 17 on the stepped-end 16 of the housing 15 and threaded openings 22 formed on the end of the circuit breaker to form the rotary operated circuit breaker 11. The top part of the rotary operator is similar to that described within the aforementioned Patent and includes a perimeter rim 18 upstanding from a top surface of the housing 15 and the handle 12A includes a slot 19 within which the locking plate 13 of FIG. 1 extends. The locking plate further extends through a slot 20 formed within the rim 18 to allow the handle to be padlocked against further rotation. The handle 12A on the rotary unit 12 interacts with the circuit breaker operating handle 21 in the manner best seen by referring now to FIG. 3.

Figure 3:
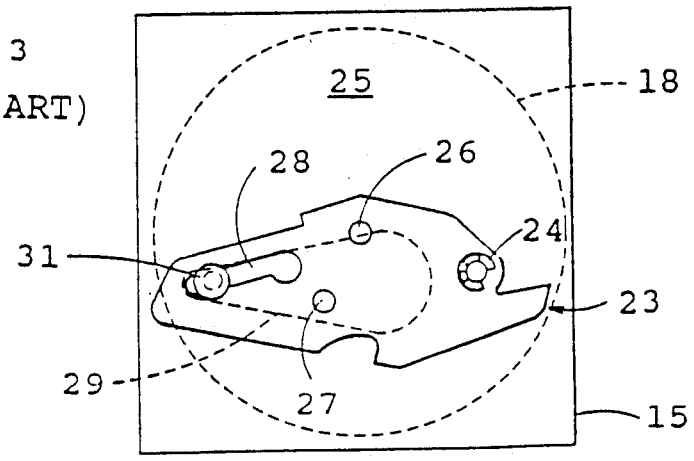
FIG. 3 (PRIOR ART)
FIG. 3 is a bottom view of the rotary operator of FIG. 2.

The lever 23 as shown in FIG. 3 is attached to the bottom 25 of the housing 15 under the rim 18 by means of the pivot pin 24 located on the top surface of the housing 15. The two posts 26, 27 extending down from the lever interact with the circuit breaker operating handle while the elongated slot 28 captures the post 31 extending down from the cam 29. The position of the circuit breaker operating handle within the posts 26, 27 accordingly determines whether the rotary handle can be padlocked independently of the actual condition of the circuit breaker contacts.

Figure 4:
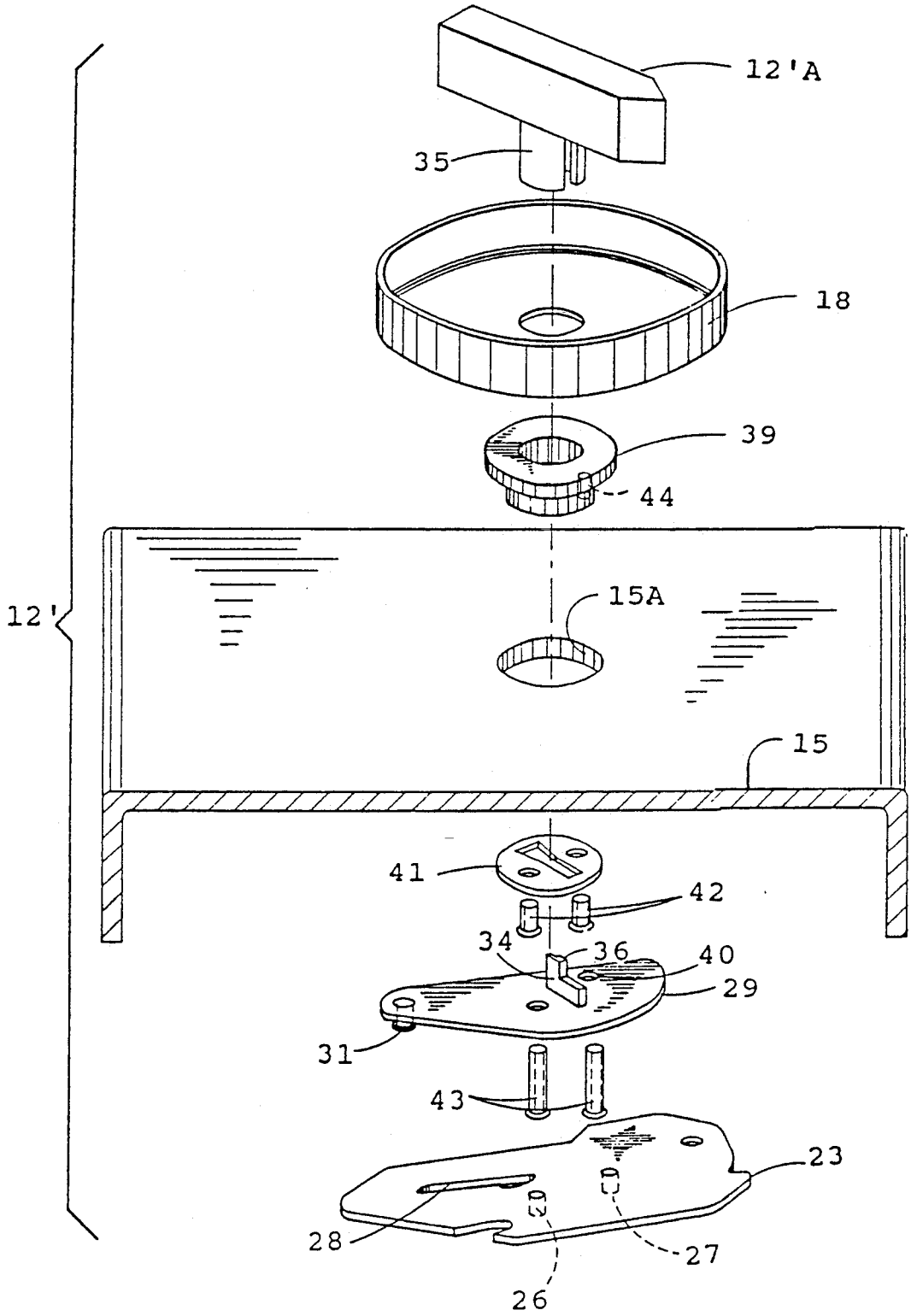
FIG. 4 is a top perspective view of the rotary operator components of the invention in isometric projection.
Figure 5:
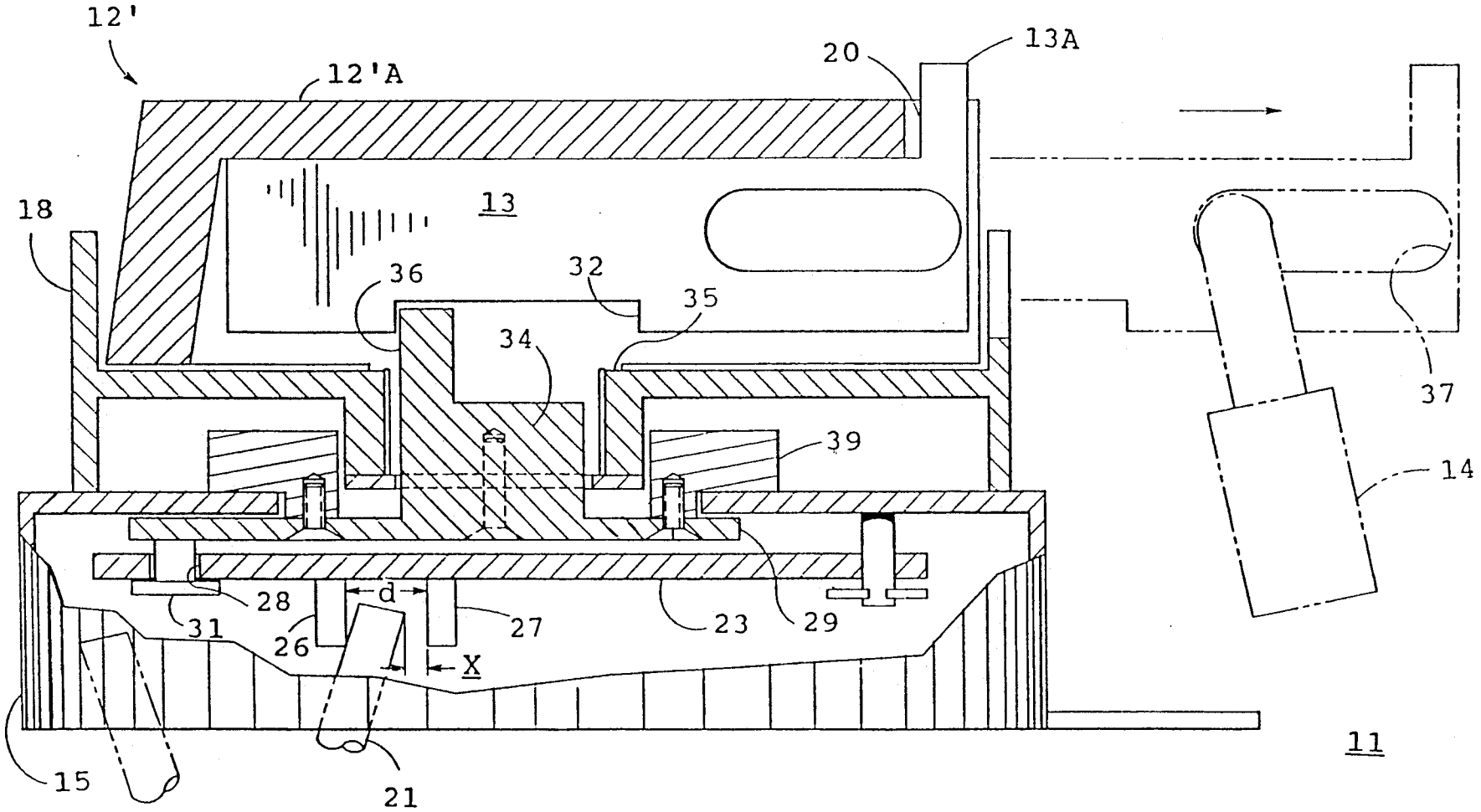
FIG. 5 is an enlarged side sectional view of the rotary handle operator of FIG. 5 attached to a circuit breaker.

When a so-called "positive off" rotary switch is required, whereby the rotary handle is prevented from being padlocked when the circuit breaker contacts are welded in their closed condition, the rotary operator 12' shown in FIGS. 4 and 5 is recommended. The rotary operator 12' is similar in many respects to that shown earlier and common components will be given common reference numerals where possible. The rotary handle 12'A is attached between the housing 15 and the cam 29 by inserting the slotted post 35 down within the opening 15A formed in the top surface of the housing. The post 35 extends within the bushing 39 arranged on a top surface of the housing and captures the upstanding plate 34 on the cam. The handle 12'A is secured in place by the attachment plate 41 and screws 42 which attach to corresponding threaded openings (not shown) on the bottom of the post 35. The perimeter rim 18 and bushing 39 are assembled on the top of the housing 15 and are held by means of the cam 29. The cam 29 is then attached to the bushing by means of thru-holes 40, screws 43 and threaded openings 44. The tab 36 on plate 34 interacts with the slot within the post 35 in the manner to be discussed below in some detail. The post 31 on the bottom of the cam is captured within the elongated slot 28 arranged in the lever 23 and controls the movement of the circuit breaker handle by means of the handle drive posts 26, 27 as described earlier. The assembled handle operator 12' is shown in FIG. 5 with the circuit breaker handle 21 in the OFF position and with the circuit breaker contacts welded together within the associated circuit breaker (not shown). The handle drive posts 26, 27 encompass the circuit breaker handle 21 and the tab 36 on the plate 34 is within a detent slot 32 formed within the locking plate 13 which prevents the locking plate from being translated to the locked position by means of the padlock 14 and slot 37 as indicated in phantom. When an attempt is made to extend the plate 13 by translation of the tab 13A, the tab 13A remains within the slot 20 since the tab 36 prevents movement of the plate by virtue of interfering within the slot 32. The plate 13 can only be translated to the locked position by removal of the tab 36 out from interference within the slot 32.

Figure 6A:
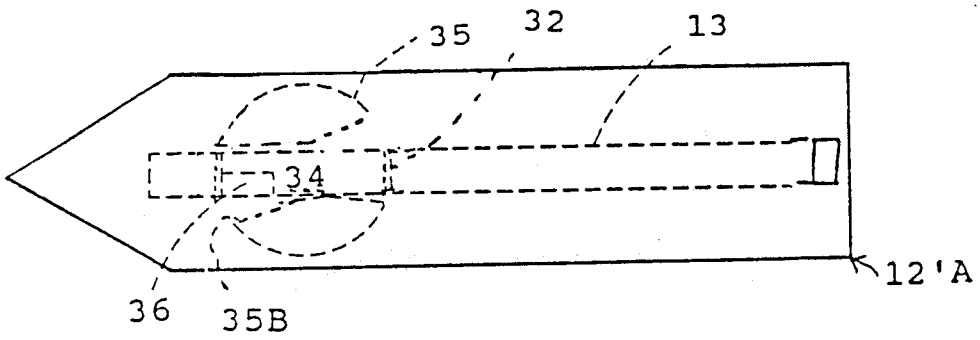
FIGS. 6A and 6B are enlarged top views of the rotary handle of FIG. 5 depicting the unlocked and locked positions respectively.
Figure 6B:
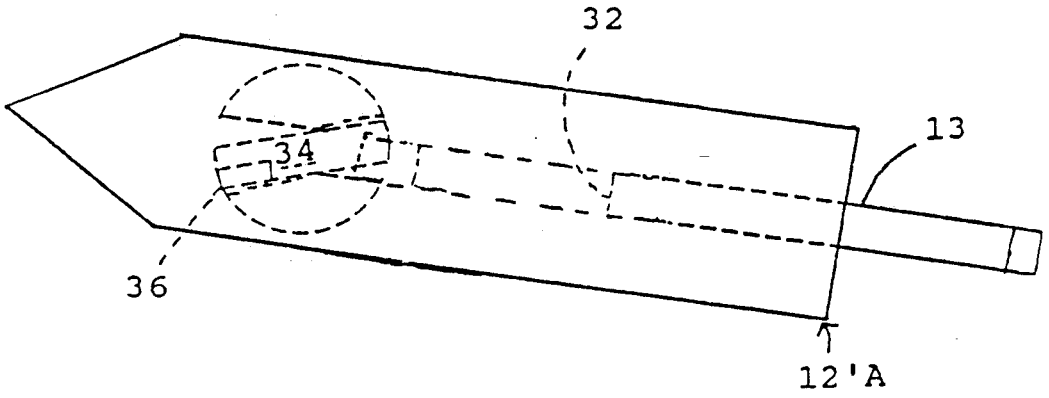

In accordance With the invention, the slotted post 35 on the bottom of the rotary handle 12'A shown in FIGS. 6A, 6B, is provided with an "hour glass" slot 35B. When the circuit breaker contacts are welded in their closed position and an attempt is made to turn the circuit breaker off by moving the circuit breaker handle from the ON to OFF position, plate 34 and tab 36 align within the slot 32 shown in FIG. 5 to thereby prevent the plate 13 from being moved to the locked position shown in phantom. When the circuit breaker contacts are in their open conditions, the circuit breaker handle is moved to its ON position to turn the circuit breaker ON, allowing tab 36 to move to the side of the slot 35B and away from the slot 32 thereby allowing translation of the plate 13 as shown in FIG. 6B. In order for the plate 13 to be moved out of the rotary handle 12'A to the padlocked condition shown in FIG. 6B, the rotary handle 12'A must move the handle drive post 27 into engagement with the circuit breaker handle 21 as best seen by referring to FIG. 5. A pre-determined separation distance d is arranged between the handle drive posts 26, 27, to set a clearance distance x between the circuit breaker handle 21 and the handle drive post 27. This clearance is sufficient to provide the lost motion required for movement of the tab 36 on plate 34 out of the detent slot 32 and allow the plate 13 to move to the locked position shown in phantom. The circuit breaker handle 21 must remain in the OFF position shown in FIG. 5 for this to occur. However, when the circuit breaker contacts are welded in their closed position, the powerful operating mechanism springs within the associated circuit breaker, such as described within U.S. Pat. No. 4,736,174 for example, exert a return force on the operating handle to prevent the handle from remaining in the OFF position. The circuit breaker handle 21 attempts to return to the ON position shown in phantom, thereby preventing tab 36 from moving out from the detent slot 32 and the handle drive post 27 from engagement with the circuit breaker operating handle. The tab 36 remains within the detent slot 32 thereby preventing the plate 13 from moving to the locked position shown in phantom.

A circuit breaker rotary operator has herein been described having positive ON indication whereby the lost motion of the associated circuit breaker handle, upon an attempt to reset the circuit breaker when the contacts are welded, is fed back to the rotary handle to position a locking tab in a detent slot formed in the rotary operator plate thereby preventing the rotary handle from being locked in the OFF position.

Having thus described our invention, what we claim by Letters Patent is:

1. An improved molded case circuit breaker rotary operator of the type consisting of a housing, a rotary handle on the housing, a cam rotatively attached to an underside of the housing and a lever rotatively attached to an underside of the cam, wherein the improvement comprises:

a locking plate slidingly arranged on said rotary handle and interacting with a clearance slot arranged on a perimeter rim upstanding on said housing for locking said rotary handle in a fixed position, said locking plate having a detent slot on a bottom thereof;

a tab upstanding from a top part of said cam, said tab being received within said detent slot to prevent translation of said locking plate when an associated circuit breaker handle is in a first position, and said tab being outside said detent slot to allow translation of locking tab when an associated circuit breaker handle is in a second position; and a post extending from a bottom of said rotary handle and terminating in a shaped slot, said shaped slot having an hourglass configuration to provide first and second positions to said tab corresponding to first and second positions of an associated circuit breaker operating handle.

2. The improved molded case circuit breaker rotary operator of claim 1 wherein said lever includes an elongated slot arranged for capturing a cam post extending down from said cam.

3. The improved molded case circuit breaker rotary operator of claim 2 wherein said lever further includes a pair of handle drive posts extending from a bottom thereof, said handle drive posts arranged on both sides of an associated circuit breaker operating handle.

4. The improved molded case circuit breaker rotary operator of claim 1 wherein said first position corresponds to an associated circuit breaker handle when a pair of contacts in an associated circuit breaker are closed.

5. The improved molded case circuit breaker rotary operator of claim 1 wherein said second position corresponds to an associated circuit breaker handle when a pair of contacts in an associated circuit breaker are open.

6. The improved molded case circuit breaker of claim 5 including a predetermined clearance distance between one of said handle drive posts and an associated circuit breaker operating handle.

* * * * *